United States Patent [19]

Spodig

[11] 4,224,590

[45] Sep. 23, 1980

[54] MAGNETIC-TECHNICAL SYSTEM WITH A MAGNETIC CIRCUIT COMPRISING AT LEAST TWO MAGNETS

[76] Inventor: Heinrich Spodig, Netteberge 202, 4714 Selm-Bork, Fed. Rep. of Germany

[21] Appl. No.: 867,217

[22] Filed: Jan. 6, 1978

Related U.S. Application Data

[63] Continuation of Ser. No. 766,352, Feb. 7, 1977, abandoned.

[30] Foreign Application Priority Data

Feb. 23, 1976 [DE] Fed. Rep. of Germany ..... 2607197

[51] Int. Cl.[3] ..... H01F 7/02

[52] U.S. Cl. ..... 335/306; 209/223 R

[58] Field of Search ..... 209/214–215, 209/219–220, 222–223, 216, 231; 210/222–223; 335/286–287, 306

[56] References Cited

U.S. PATENT DOCUMENTS

| | | | |
|---|---|---|---|
| 449,610 | 3/1891 | Moffatt | 209/223 A |
| 639,062 | 12/1899 | Kreuser | 209/219 |
| 2,430,157 | 11/1947 | Byrd | 209/215 |
| 3,345,594 | 10/1967 | Vermeiren | 335/306 |
| 3,608,718 | 9/1971 | Aubrey et al. | 209/214 |
| 3,960,717 | 6/1976 | Spodig | 209/226 |

FOREIGN PATENT DOCUMENTS

| | | | |
|---|---|---|---|
| 2106227 | 9/1971 | Fed. Rep. of Germany | 335/306 |
| 807118 | 1/1959 | United Kingdom . | |

OTHER PUBLICATIONS

Indiana Permanent Magnet Manual, No. 4, 1948.

*Primary Examiner*—Robert Halper

*Attorney, Agent, or Firm*—Wallenstein, Spangenberg, Hattis & Strampel

[57] ABSTRACT

Magnetic-technical systems useful in magnetic separators for separating magnetic materials from liquid or dry materials containing magnetic particles. The magnetic technical systems are characterized by possessing one magnetic circuit comprising at least two magnets and at least one operating air gap, and being further characterized by the fact that the circuit containing the magnets is closed and that within said circuit there is an operating gap in relation to two mild iron or steel parts which in each case are arranged between two interconnected homopolar magnets.

1 Claim, 5 Drawing Figures

FIG. 1
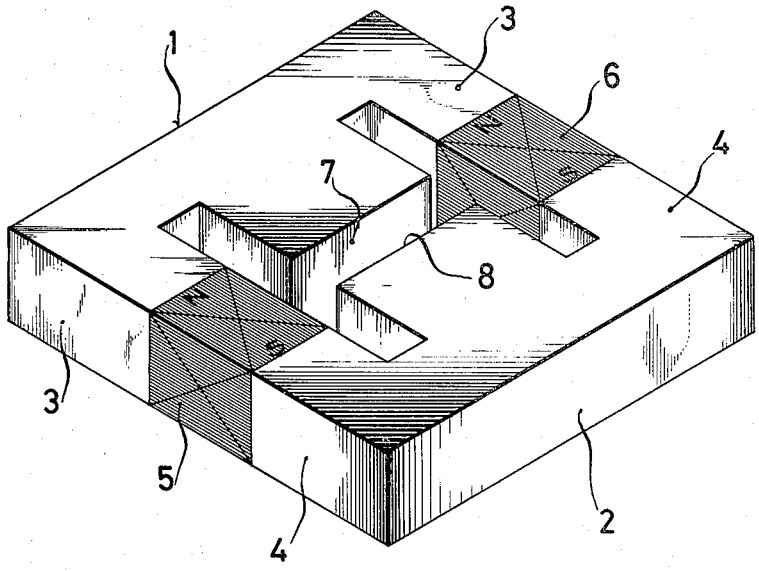
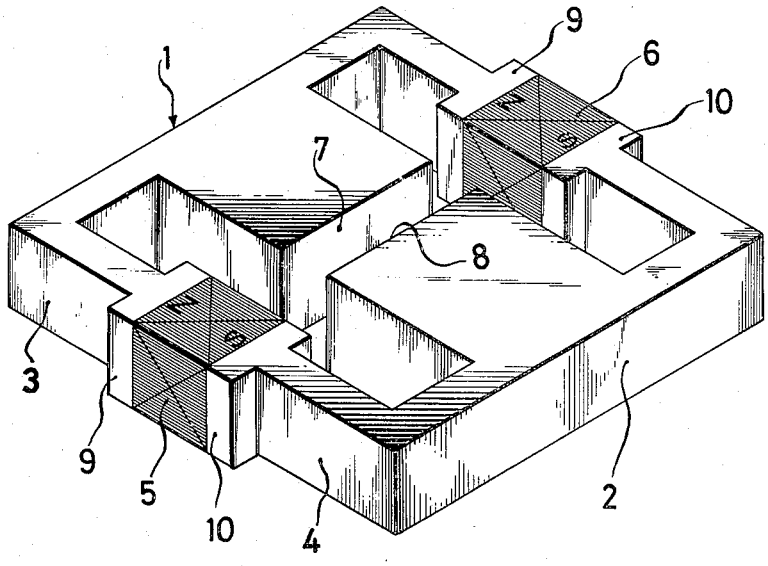
FIG. 2

MAGNETIC-TECHNICAL SYSTEM WITH A MAGNETIC CIRCUIT COMPRISING AT LEAST TWO MAGNETS

This application is a continuation of application Ser. No. 766,352, filed Feb. 7, 1977, now abandoned.

The present invention relates to a magnetic-technical system with one magnetic circuit of the type which comprises at least two magnets and at least one operating air gap. Such a system, broadly speaking, has heretofore been known to the art for the magnetic separation of fine grain, pulverulent or dust-like materials, especially of ores, as is shown in British Pat. No. 807,118. Such known systems, however, have numbers of marked deficiencies in that serious transducer dissipation losses occur at the operating air gaps; and, in addition, considerable uncontrolled scatterings at the operating gaps toward the frame and the like extending outside the effective area cause the material to be separated to quickly plug the gaps, so that operational disturbances take place requiring frequent shut downs for cleaning purposes.

The present invention effectively overcomes the deficiencies in prior art magnetic separating devices, such as that of the aforesaid British patent. In accordance with the present invention, novel magnetic-technical systems have been devised of so concentrating the force lines upon and in the operating air gaps whereby the external fields of dispersion are maintained small and dispersions outside the effective area are very largely avoided. This is achieved, in accordance with the present invention, by construction wherein the circuit containing the magnets is closed, and within the circuit an operating air gap is provided which consists of or is related to two mild iron or steel parts which in each case are arranged between two interconnected magnets of the same polarity. As a result a system with greatly less dispersion is achieved which inhibits external dispersion to a very substantial extent and generates a more powerful magnetic field in the operating air gap, all in sharp contrast to the aforesaid known prior art system.

The details of the invention are set forth below in connection with illustrative preferred embodiments of the invention as shown in the accompanying drawings wherein:

FIG. 1 shows a perspective view of one embodiment of the magnetic-technical system of the present invention;

FIG. 2 shows a perspective view of another embodiment of a magnetic-technical system of the invention;

Figure 3:
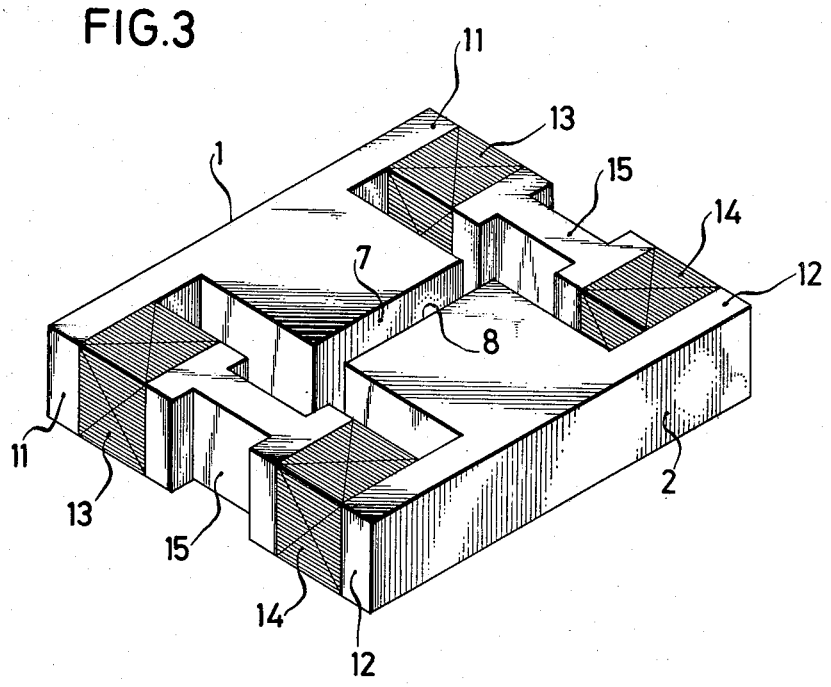
FIG. 3 shows a perspective view of still another embodiment of a magnetic-technical system of the invention.

Referring, now, more particularly to the embodiment of FIG. 1, the magnetic-technical system is formed by a closed frame composed of E-shaped frame parts 1, 2, of any desired cross-sections, and permanent magnets 5, 6 having the same or essentially the same cross-section interposed between the outer or external frontal surfaces 3, 4 of the respective frame parts 1, 2. The outer or external frontal surfaces extend up to the connecting surfaces between the mild iron or steel parts 1, 2 and the magnets 5, 6 as is clearly shown in FIG. 1. The permanent magnets 5, 6 are arranged parallel and in the same direction of magnetization in relation to each other, so that a closed magnetic circuit is formed from the one frame part 1 to the other frame part 2 via the permanent magnets 5, 6. Thereby the frame part 1 has a North polarity and the frame part 2 has a South polarity. The frame parts 1, 2 are formed to provide central frontal surfaces 7, 8, respectively, which extend inwardly or interiorly of the frame whereby the opposite polarities directly face each other. Thus, an operating air gap of particularly high magnetic field strength is created between the central frontal surfaces 7, 8 within a closed magnetic circuit 1, 2, 5, 6, the more so because magnetic dispersions cannot occur from the outer frontal surfaces 3, 4 to the adjacent poles of the magnets 5, 6 due to homopolarity. From the foregoing, it will be seen, in connection with the homopolar arrangement of the magnets 5, 6 in the closed circuit of FIG. 1, that the projecting central frontal surfaces 7, 8 form analogous auxiliary poles at the operating air gap together with the poles of magnets 5, 6, i.e., they form, corresponding to the external frontal surfaces 3 in the mild iron or steel part 1 at 7, an auxiliary pole N′ and, corresponding to the external frontal surfaces 4, the auxiliary pole S′. The consequence of this is that, between the N poles of the magnets 5, 6 and the N′ pole at the frontal surface 7 or the S poles of the magnets 5, 6 and the S′ pole at the frontal surface 8 respectively, no stray fields can build up and, therefore, the entire force lines extend in the operating air gap in the magnetizing direction of the permanent magnets.

The magnetic-technical system shown in FIG. 1 and described above may be considered as a permanent magnet circuit device. The magnets are, in all due substance, undirected, i.e., they are magnetized in the same direction in the closed circuit, and the mild iron or steel parts which form the closed frame together with the magnet, for their part, form an operational air gap and wherein the auxiliary poles are homopolar in relation to the magnet poles so that, as mentioned above, essentially no stray fields are present between the operational air gap on the one hand, i.e., the auxiliary poles N′ or S′, respectively, and the magnet poles N or S, respectively, on the two sides of the frame. Thus, the magnetic field builds up unhampered in the operational air gap and is concentrated therein practically without any losses.

The magnetic-technical system represented in FIG. 2 differs from that of FIG. 1 in that the frame parts 1, 2 have a rectangular cross-section and the external frontal surfaces 3, 4 are increased by flanges 9, 10 to the dimensions of practically square permanent magnets 5, 6. In this way a practically unimpeded transfer of the magnetic force lines takes place from the permanent magnets 5, 6 to the frame parts 1, 2 via the flanges 9, 10, even if the permanent magents 5, 6 and the frame parts 1, 2 have varying cross-sections. As in the system according to FIG. 1, the operating air gap in the system of FIG. 2 is located between the central frontal surfaces 7, 8 within a closed magnetic circuit extending thereabout.

In place of two permanent magnets shown in the embodiments of FIGS. 1 and 2, more than two, that is, a multiple of two permanent magnets can readily be applied for the magnetic-technical system according to the invention. FIG. 3 illustrates such a system utilizing four magnets, for example. Here the frame parts 1, 2 have a T-like shape. The four permanent magnets 13, 14 are connected in each case by a guiding part 15, made from soft iron or mild steel, for example as double T-parts which are disposed between free leg members 11, 12, placed opposite each other, of the frame parts, at the interior sides. The aforesaid mild iron or steel guide part 15 connects the permanent magnets 13, 14 with opposite poles, so that the opposite exterior poles have opposite polarity, and the frame parts 1, 2 are of heterogeneous polarity. The principle according to the invention of a closed magnetic circuit and an operating air gap located in this magnetic circuit, thus, also is present in the embodiment of FIG. 3.

Figure 4:
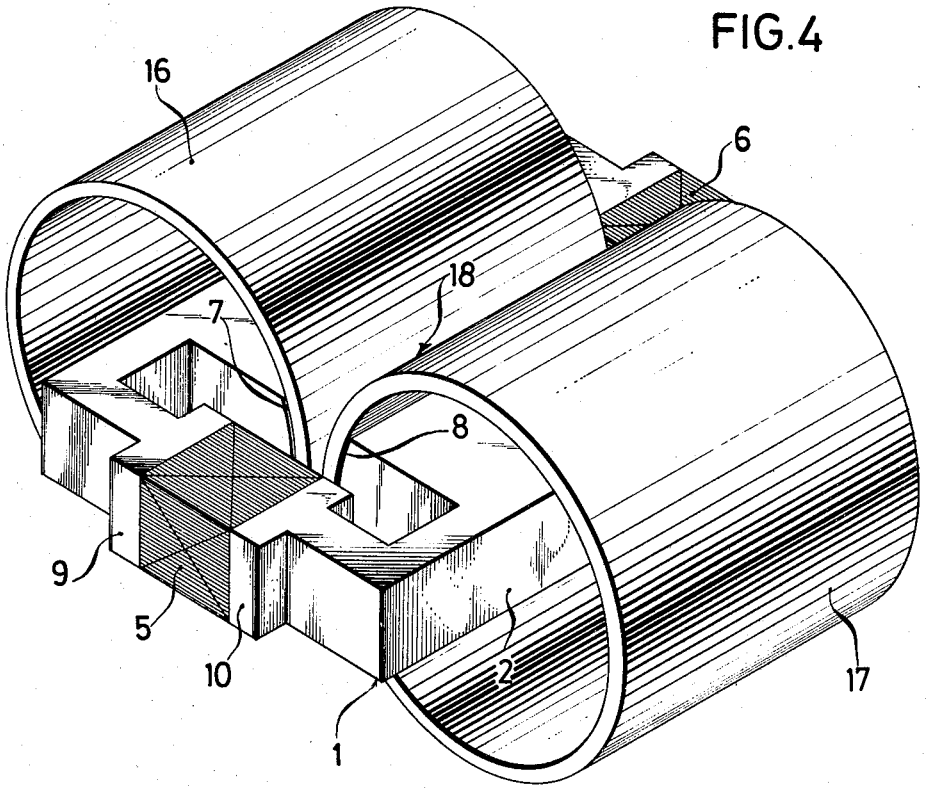
FIG. 4 shows a perspective view of a double drum magnetic separator arrangement utilizing the magnetic-technical system of FIG. 2.

FIG. 4 shows on illustrative manner of embodying the magnetic-technical system of FIGS. 1 or 2 into a magnetic separating device of the type which utilizes two rotatable drums. The drums 16, 17, preferably made of a mild iron or steel, are arranged in the manner shown in FIG. 4 in relation to the magnetic-technical systems of either of FIGS. 1 or 2, so as to be rotatable on bearings (not shown). The said drums extend into and through the gap formed between the central frontal surfaces 7, 8 and extend outside of and around the frame parts 1, 2. The polarization of the drums 16, 17 is accomplished via the frame parts 1, 2 with opposite polarity. Thereby a particularly powerful magnetic field forms at the point where the drums 16, 17 are opposite each other with a gap 18 therebetween. This gap 18 may be used as separation gap for liquid or dry material containing magnetic particles, whereby the material introduced into the gap 18, by feeding means known per se and not shown in the drawing, insofar as it is not ferruginous, drops through the gap 18 and the closed frame downward, while the ferruginous particles adhere to and are collected by the drums 16, 17 and conveyed out of the gap 18 by the rotation of the drums 16, 17.

Figure 5:
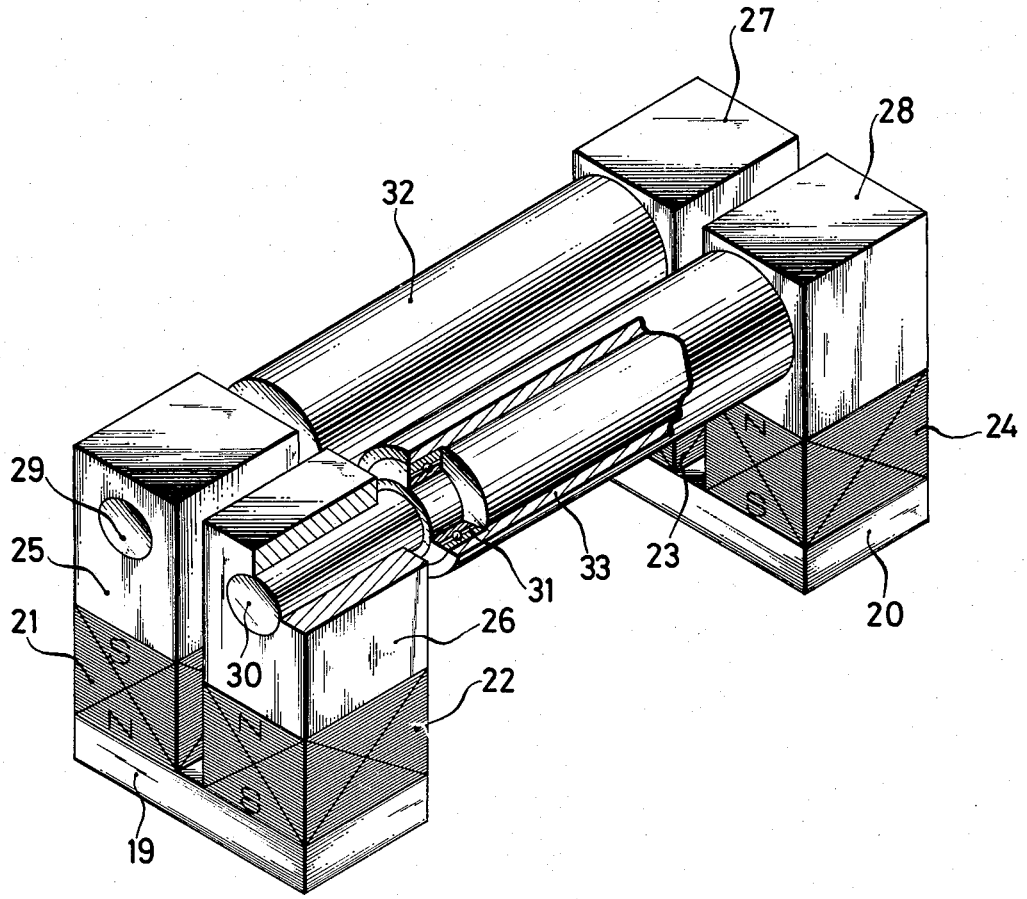
FIG. 5 shows a perspective view of magnetic table roller with two rollers built up from a magnetic-technical system of the invention.

FIG. 5 shows a magnetic table roller, for example with two rollers, which utilizes a magnetic-technical system of the present invention. The system is designed on the basis of four magnets within the closed frame, whereby mild iron or steel parts in the form of plates 19, 20 connect the permanent magnets 21, 22, 23, 24, with each other in pairs. In contrast with the system of FIG. 3, which likewise is based on the use of four permanent magnets, the permanent magnets 21, 22, 23, 24 used in the device of FIG. 5 are not connected to the plates 19, 20 in their symmetry plane, but are connected outside thereof at a 90° angle. Thus, pairs of columns are formed with the mild iron or steel parts 25, 26, 27, 28 which are connected by means of the shafts 29, 30, and, in that way, the magnetic circuit is closed. Because the permanent magnets 21, 22, 23, 24 connected by the plates 19, 20 have among each other an opposite polarity, but in pairs, they have the same direction of magnetization in relation to each other. The shafts 29, 30 carry cylindrical rollers 32, 33 made of magnetic material and are provided with ball bearings 31, there being a gap between said rollers 32, 33 of any desired suitable dimensions. The rollers 32, 33 are rotated by any suitable drive means (not shown) and may be used as table roller pulleys with magnetic attraction for conveying magnetically adhering material. While FIG. 5 involves the use of two table roller pulleys for a magnetic table roller, any number of pulleys can be utilized with correspondingly modified magnetic-technical systems, the number of the pulleys and of the associated magnetic-technical systems being merely a matter of the length of the conveying stretch. It will also be readily understood and appreciated that the pairs of permanent magnets also may be interconnected, without changing the magnetic flux of force in the magnetic-technical system as, for instance, by using one joint plate in lieu of the individual plates 19, 20.

It will be understood that the terms "homopolar" and "heteropolar" are used above in accordance with their commonly understood meanings. Thus, "homopolar" means analogous poles or poles of similar polarity such as N,N poles or S,S poles; whereas "heteropolar" means nonanalogous poles or poles of opposite polarity such as N,S poles or S,N poles, in respective arrangement to each other. Thus, by way of specific example, taking the embodiment of FIG. 4, the drums 16 and 17 in the operational air gap are oppositely polarized, i.e. are heteropolar, while magnets 5 and 6 are homopolar, i.e. arranged in the same magnetic direction and parallelly. Again, in the embodiment of FIG. 4 in which the drums 16 and 17 are heteropolar in the operational air gap, and wherein the permanent magnet circuit arrangement is used for the separation of magnetic parts comprising goods, the drums 16 and 17, which are rotatably arranged about the mild iron or steel parts 1, 2 are oppositely polarized by the mild iron or steel parts of frame 1,2 at their central frontal surfaces.

It may be pointed out that mild iron or steel is more costly than various other steels so that it is desirable to minimize the amount thereof to be used in the magnetic-technical system of the present invention, consistent, however, with obtaining the objectives of the invention. Thus, as is particularly clearly shown in FIGS. 2 and 3, savings in the amount of mild iron or steel are achieved by using mild iron or steel parts having a smaller cross-section than that of the permanent magnets. To this end, the mild iron or steel parts are provided with the aforedescribed flanges 9,10 at their frontal surfaces abutting the aforedescribed magnets 5,6, said flanges having the same cross-section as said magnets. This enables, for instance, as described above in regard to the embodiment of FIG. 3, the utilization for the guiding part 15 double T-shaped member the guiding part 15 and the frame parts 1,2 in the form of T-shaped configurations.

While preferred embodiments of the invention have been disclosed and described, it will be readily understood and appreciated that various changes can be made, utilizing the principles disclosed and taught herein, without departing from the invention. Thus, the frame, the frame parts and the permanent magnets can take forms other than those exemplified in the several illustrative embodiments of the invention; and different cross-sections may be chosen and/or the dimensions and the shapes of the frames can be modified into circular or rectangular forms. In addition, several frame-like systems can be consolidated into a single system, all providing, however, that they utilize a closed magnetic circuit with the mild iron or steel parts forming the operating gap placed therein.

What is claimed is:

1. Permanent magnetic-technical system comprising two symmetrically arranged T-shaped mild iron or steel parts resting against opposite poles of separate spaced sets of permanent magnets and forming intermediate frontal surfaces projecting into the space between said sets of permanent magnets, which oppose each other in the direction of magnetizing of the magnets and forming by means of said frontal surfaces an operating air gap with opposite polarities, and wherein, between the mild iron or steel parts, four parallelly magnetized permanent magnets are arranged which are connected in series in pairs in the direction of magnetizing by means of each of two separate I-shaped mild iron or steel parts symmetrically arranged to the operating air gap, said magnetized permanent magnets being positioned out of alignment with the said air gap.

* * * * *